US011751616B2

(12) United States Patent
Bailliet

(10) Patent No.: US 11,751,616 B2
(45) Date of Patent: Sep. 12, 2023

(54) FACE SHIELD AND METHOD OF USE

(71) Applicant: Amdrecor, Inc., Houston, TX (US)

(72) Inventor: John Bailliet, Houston, TX (US)

(73) Assignee: Amdrecor, Inc., Houston, TX (US)

( * ) Notice: Subject to any disclaimer, the term of this patent is extended or adjusted under 35 U.S.C. 154(b) by 89 days.

(21) Appl. No.: 17/007,721

(22) Filed: Aug. 31, 2020

(65) Prior Publication Data

US 2022/0061425 A1 Mar. 3, 2022

(51) Int. Cl.
*A41D 13/11* (2006.01)
*A41D 31/30* (2019.01)

(52) U.S. Cl.
CPC ..... *A41D 13/1184* (2013.01); *A41D 13/1161* (2013.01); *A41D 13/1192* (2013.01); *A41D 31/30* (2019.02); *A41D 13/11* (2013.01); *A41D 13/1107* (2013.01); *A41D 13/1123* (2013.01); *A41D 13/1176* (2013.01); *A41D 2500/30* (2013.01)

(58) Field of Classification Search
CPC ..... A41D 13/1184; A41D 13/1161; A41D 13/1192; A41D 13/1107; A41D 13/1176; A41D 13/11; A41D 13/1123; A41D 2500/30
USPC ..... 2/9
See application file for complete search history.

(56) References Cited

U.S. PATENT DOCUMENTS 2,729,820 A * 1/1956 Anderson ..... A42B 3/225 2/9
2,758,307 A * 8/1956 Treiber ..... A41D 13/1184 2/9
2,881,443 A 4/1959 Barker, Jr.
3,594,816 A 7/1971 Webb et al.
3,686,690 A * 8/1972 Webb ..... A42B 3/225 2/9
3,774,239 A * 11/1973 Kotzar ..... A42B 3/227 2/10
3,797,042 A 3/1974 Gager, Jr.
4,625,341 A 12/1986 Broersma
4,701,965 A 10/1987 Landis
4,852,185 A 8/1989 Olson
4,950,445 A 8/1990 Salce et al.
5,365,615 A 11/1994 Piszkin
5,471,679 A 12/1995 Paoluccio
5,647,060 A 7/1997 Lee
5,673,431 A * 10/1997 Batty ..... A61F 9/027 2/9
5,732,410 A 3/1998 Machson
5,765,223 A * 6/1998 McCausland ..... A41D 13/1184 2/427
5,970,514 A * 10/1999 Wang-Lee ..... A42B 3/225 2/9

(Continued)

FOREIGN PATENT DOCUMENTS

EP 1344466 9/2003
WO 2006135231 12/2006
WO 2009023599 2/2009

*Primary Examiner* — Khaled Annis
*Assistant Examiner* — Dakota Marin
(74) *Attorney, Agent, or Firm* — Stephens Juren, PLLC; Matthew Juren; Kelly Stephens

(57) ABSTRACT

An apparatus and method for use of an improved face shield assembly which prevents foreign materials or contaminants from vertically migrating from the above a wearer's head to the area around a wearer's face, eyes, nose and mouth.

20 Claims, 4 Drawing Sheets

(56) References Cited

U.S. PATENT DOCUMENTS

| | | | | |
|---|---|---|---|---|
| 6,154,881 | A | 12/2000 | Lee | |
| 6,367,085 | B1 * | 4/2002 | Berg | A62B 17/04 2/202 |
| 8,336,123 | B2 * | 12/2012 | Gleason | A42B 3/225 2/9 |
| D732,242 | S | 6/2015 | Miller et al. | |
| 9,532,617 | B2 | 1/2017 | Miller et al. | |
| 9,839,798 | B2 * | 12/2017 | Franke | A62B 18/082 |
| 10,881,157 | B1 * | 1/2021 | Anderson | A41D 13/1107 |
| 11,044,958 | B1 * | 6/2021 | Mason | A41F 1/002 |
| 11,266,188 | B2 * | 3/2022 | Basta | A41D 13/1161 |
| 11,617,403 | B2 * | 4/2023 | Stephens | B32B 5/02 2/9 |
| 2011/0265236 | A1 * | 11/2011 | Stoll | A41D 13/1184 2/9 |
| 2013/0291272 | A1 | 11/2013 | Bourque | |
| 2015/0173953 | A1 * | 6/2015 | Wang | A61F 9/025 128/858 |
| 2016/0050990 | A1 | 2/2016 | Hayes | |
| 2021/0274861 | A1 * | 9/2021 | Conrad | B03C 3/09 |
| 2021/0361000 | A1 * | 11/2021 | Choi | A41D 13/1184 |
| 2021/0386137 | A1 * | 12/2021 | Martino | A41D 13/1184 |
| 2021/0392970 | A1 * | 12/2021 | Basta | A41D 13/1161 |
| 2021/0392973 | A1 * | 12/2021 | Whitehead | A41D 13/1184 |
| 2022/0030976 | A1 * | 2/2022 | Harris | A41D 13/1161 |

* cited by examiner

FACE SHIELD AND METHOD OF USE

CROSS-REFERENCE TO RELATED APPLICATIONS

Not applicable.

STATEMENT REGARDING FEDERALLY SPONSORED RESEARCH

Not applicable.

BACKGROUND

The present invention generally relates to an improved face shield assembly and method of use.

The present invention is distinguished over the following prior art:

Patent WO 2009/023599 discloses a contoured face shield and method of producing optically clear parts. The present invention does not produce optically clear parts, but is a face shield assembly.

Patent WO 2006/135231 discloses a skullcap/baseball cap with ear plugs. The present invention does not disclose a skullcap/baseball cap with ear plugs.

US Application 2016/0050990 discloses a face shield attachment for a hat brim. The present invention is not a face shield attachment to a hat brim.

US Application 2013/0291272 discloses a single piece face cover. The present invention is not a single piece face cover.

US Application 2011/0265236 discloses a face shield with two clear plastic visors. The present invention does not have two clear plastic visors.

U.S. Pat. No. 4,701,965 is a visor type of mask for a dentist. The present invention is a for a two-piece face shield assembly and has no vents.

U.S. Pat. No. 5,732,410 is a face shield having a closable drape. The present invention is not a face shield with a closable drape.

U.S. Pat. No. 5,154,881 is a pivoting face mask. The present invention is not a pivoting face mask.

U.S. Pat. No. 9,532,617 is a disposable face shield with vent holes. The present invention does not disclose vent holes.

U.S. Pat. No. 5,673,431 is a flip up face mask safety shield. The present invention is not a flip up face mask safety shield.

U.S. Pat. No. 5,647,060 is a flip up face mask shield assembly. The present invention is not a flip up face mask shield assembly.

U.S. Pat. No. 5,471,679 is a face protector with an eyeglass frame. The present invention is not a face protector with an eyeglass frame.

U.S. Pat. No. 5,365,615 is a head gear face shield. The present invention is not a headgear sports type helmet with a universal mounting.

U.S. Pat. No. 4,950,445 is a method for vacuum forming a face shield. The present invention is not a method for vacuum forming a face shield.

U.S. Pat. No. 4,852,185 is a protective face shield with vents. The present invention does not have vents.

U.S. Pat. No. 4,625,341 is a removable attachable shield for a helmet visor. The present invention is not a removable attachable shield for a helmet visor.

U.S. Pat. No. 3,797,042 is a visor and face shield helmet attachment. The present invention is not a visor and face shield attachment.

SUMMARY

In some embodiments of the present invention, the present invention is an improved halo brim for a face shield assembly. The halo brim comprises a frame to flexibly fit around and attach to a wearer's head. The frame further comprises a lip for engagement with the cap and optionally, hooks for attachment of a restraining band to secure the face shield assembly on a wearer's head. The halo brim further comprises a shelf or cap extending radially around the frame for attachment to a face shield. This cap further comprises attachment knobs and channels onto which a face shield may be attached to the halo brim, and which provides a minimum space between the wearer's forehead and the face shield. The knobs may be of industry standard or may be shaped like a mushroom with a flattened head. In the flexed or expanded position the lip engages the cap section of the halo brim sealing the space between the face shield and the wearer's forehead and preventing vertical entry of contaminants and/or particulates from above. In some embodiments of the present invention, the lip may be of varying shapes or sizes to improve the engagement between the lip and the cap. In some embodiments of the present invention, the lip may flair outward near the bridge of the frame or, alternatively, it may flair outward distal from the frame as needed to provide for better engagement.

In some embodiments of the present invention, the present invention is an improved face shield assembly comprising the improved halo brim and a face shield. In some embodiments of the present invention, the face shield may have multiple sets of indents or holes to accept the knobs of the cap providing the wearer the ability to change the angle of the face shield with the cap and the wearer's face. In some embodiments of the present invention, the face shield is optically clear; in other embodiments, the face shield may be coated or tinted.

In several embodiments, the present invention comprises a novel design and method of providing a seal to exclude contaminants and/or particulates from contacting the wearer's eyes, nose or mouth.

In some embodiments of the present invention, a feature of the present inventive design which distinguishes the present invention from other technology for face shield assemblies is the seal created when the lip engages the cap of the halo brim, creating a seal and preventing the vertical incursion of contaminants and/or particulates to the eyes, nose, or mouth of a wearer.

In some embodiments, the present invention is an improved halo brim comprising a frame, a cap and a bridge; said frame further comprising a lip, and optionally, hooks; said cap further comprising cap slots and knobs; wherein said lip engages with the cap in the outwardly flexed position of the frame creating a seal to prevent the migration of contaminants and/or particulates from the top side of the brim to the face of a wearer. The hooks, if included, allow the wearer to use an elastic band, tie or string to secure the frame to the wearer's head. In some embodiments of the present invention, the frame of the improved halo brim is flexible. In some embodiments of the present inventions, the lip and the cap are manufactured as a single piece for the entire span of the cap, the portion of the frame extending beyond the cap being flexible. In some embodiments of the present invention, the improved halo brim is manufactured as a single piece. In some embodiments of the present invention, the improved halo brim is manufactured with two or more pieces and assembled by mechanical connectors, glued or welded. In some embodiments of the present invention, the improved halo brim is manufactured from polystyrene, other plastic, metal, rubber or fibrous material. In some embodiments of the present invention, the improved halo brim is manufactured from material infused with zinc and/or copper to enhance its antimicrobial/antifungal properties. In some embodiments of the present invention, the lip may be of varying shapes and widths to encourage engagement with the cap. In some embodiments of the present invention, the lip may flair outward near the bridge of the frame, or it may flair outward distal from the frame as needed to provide better engagement. In some embodiments of the present invention, the cap of the improved halo brim has a width of between 0.5 inches and 1.5 inches to provide minimal space between the face shield and the face of a wearer providing more comfort and to decrease fogging of the shield. In some embodiments of the present invention, the knobs may be of an industry standard or they may be shaped like a mushroom with a flattened head. In some embodiments of the present invention, the face shield may have multiple holes or detents to allow a wearer to change the angle between the face shield and the cap. In some embodiments of the present invention, the area on the top side of the cap is used to imprint a company name or logo.

In some embodiments of the present invention, the present invention is an improved face shield assembly comprising an improved halo brim and a face shield. In some embodiments, said improved halo brim comprises a frame, a cap and a bridge; said frame further comprising a lip and optional hooks; said cap further comprising cap slots and knobs; wherein said lip engages with the cap in the outwardly flexed position of the frame creating a seal to prevent the migration of contaminants and/or particulates from the top side of the brim to the face of a wearer. In some embodiments of the invention, the lip may be constructed with varying shapes to encourage or improve engagement with the cap. In some embodiments of the present invention, the lip may flair outward near the bridge of the frame or it may flair outward distal from the frame as needed to provide for better engagement. In some embodiments, the face shield further comprises detents or holes. In some embodiments, said face shield is attached to the cap of the improved halo brim by inserting the side edges of the face shield into the cap slots and inserting the knobs of the cap into the detents or holes of the face shield. In some embodiments of the present invention, the face shield has multiple sets of detents or holes allowing the wearer to vary the angle of the face shield to the cap. In some embodiments, the face shield is optically clear; in other embodiments, the face shield is coated or tinted. In some embodiments of the present invention, the frame of the improved halo brim is flexible. In some embodiments of the present invention, the improved halo brim is manufactured as a single piece. In some embodiments of the present invention, the improved halo brim is manufactured in two or more pieces and assembled by mechanical connectors, glued or welded. In some embodiments of the present invention, the improved halo brim is manufactured from polystyrene, other plastic, metal, rubber or fibrous material. In some embodiments of the present invention, the improved halo brim is manufactured from material infused with zinc and/or copper to enhance its antimicrobial/antifungal properties. In some embodiments of the present invention, the cap has a width of between 0.5 inches and 1.5 inches to provide a minimal space between the face shield and the face of a wearer to provide more comfort and to decrease fogging of the shield.

In some embodiments of the present invention, the present invention is a method of preventing contaminants and/or particulates from migrating vertically downward into the face of a wearer of a face shield assembly comprising; obtaining an improved halo brim comprising a frame, a cap and a bridge; said frame further comprising a lip and, optionally, hooks; said cap further comprising cap slots and knobs; wherein said lip engages with the cap in the outwardly flexed position, creating a seal to prevent the migration of contaminants and/or particulates from the top side of the brim to the face of a wearer. In some embodiments, a face shield is obtained further comprising detents or holes for attaching to the improved halo brim. In some embodiments, the face shield assembly is assembled by attaching the face shield to the improved halo brim by inserting the side edges of the face shield into the cap slots of the improved halo brim and inserting the knobs of the cap into the detents or holes of the face shield; and placing the face shield assembly on the head of a wearer, thereby outwardly flexing the frame of the improved halo brim such that the lip of the frame extends outwardly to engage the edge of the cap of the improved halo brim creating a seal. In some embodiments of the present invention, the frame of the improved halo brim is flexible. In some embodiments of the present invention, the improved halo brim is manufactured as a single piece. In some embodiments of the present invention, the improved halo brim is manufactured in two or more pieces and assembled by mechanical connectors, glued or welded. In some embodiments of the present invention, the improved halo brim is manufactured from polystyrene, other plastic, metal, rubber or fibrous material. In some embodiments of the present invention, the improved halo brim is manufactured from material infused with zinc and/or copper to enhance its antimicrobial/antifungal properties. In some embodiments of the present invention, the improved halo brim the cap of the brim has a width of between 0.5 inches and 1.5 inches to provide space between the face shield and the face of a wearer to provide more comfort and to decrease fogging of the face shield. In some embodiments of the present invention, the face shield has multiple sets of holes or detents to allow a wearer to change the angle between the cap and the face shield. In some embodiments of the present invention, the lip may be of varying shapes and widths to encourage engagement with the cap. In some embodiments of the present invention, the lip may flair outward near the bridge of the frame or it may flair outward distal from the frame as needed to provide for better engagement.

BRIEF DESCRIPTION OF THE DRAWINGS

For a more complete understanding of the present disclosure and the advantages thereof, reference is now made to the following descriptions to be taken in conjunction with the accompanying drawings describing specific embodiments of the disclosure, wherein.

DETAILED DESCRIPTION

Figure 1:
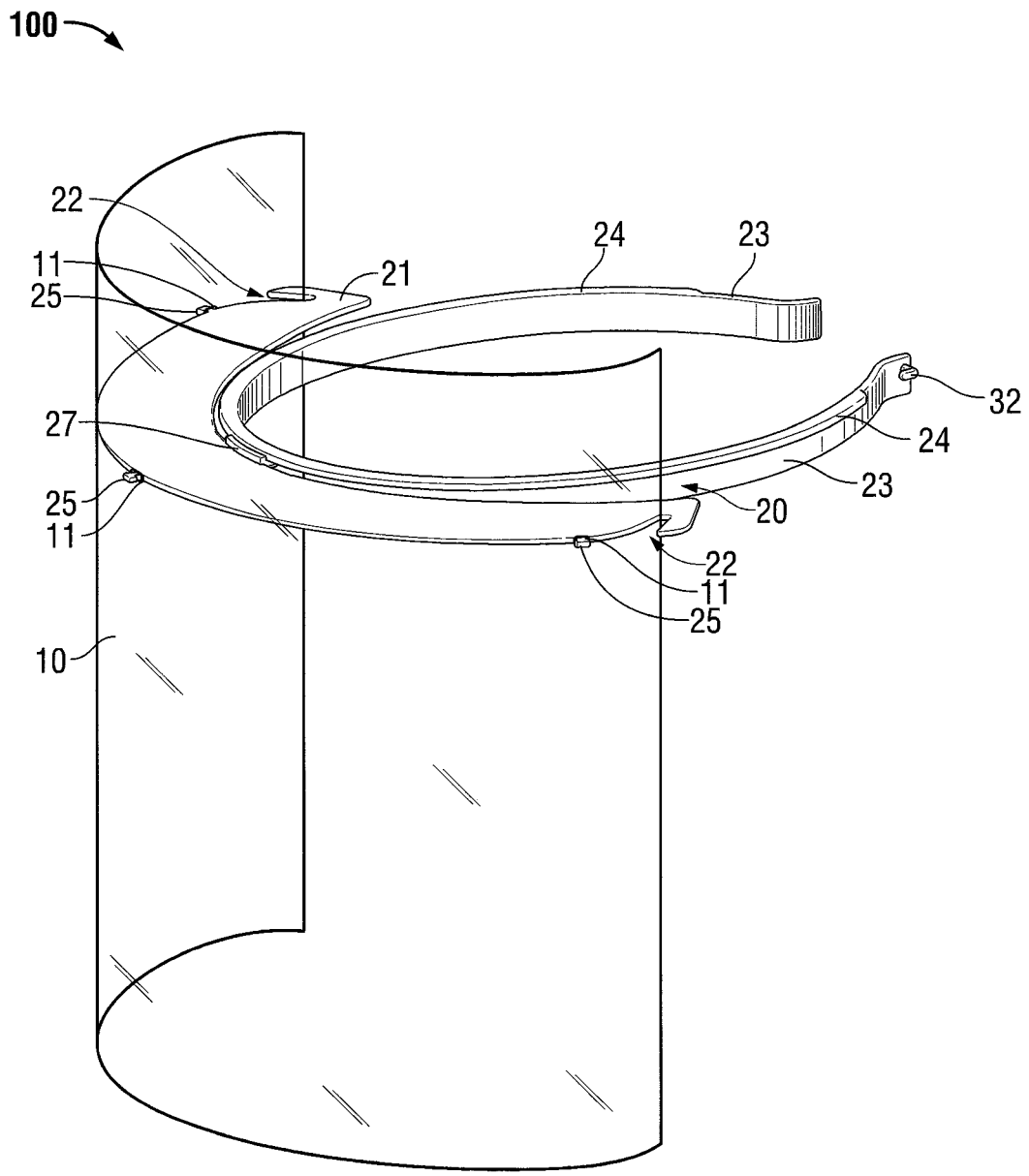
FIG. 1 illustrates one embodiment of the improved face shield assembly, shown from a three-quarter side view.

One or more illustrative embodiments incorporating the invention disclosed herein are presented below. Applicant has created a revolutionary and improved face shield assembly and method of use.

In the following description, certain details are set forth such as specific quantities, sizes, etc. to provide a thorough understanding of the present embodiments disclosed herein. However, it will be evident to those of ordinary skill in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

Referring to the drawings in general, it will be understood that the illustrations are for the purpose of describing embodiments of the disclosure and are not intended to be limiting thereto. Drawings are not necessarily to scale, and arrangements of specific units in the drawings can vary.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a term would render it meaningless, or essentially meaningless, the definition should be taken from Webster's Dictionary 2020, 11$^{th}$ Edition. Definitions and/or interpretations should not be incorporated from other patent applications, patents, or publications, related or not, unless specifically stated in this specification, or if the incorporation is necessary for maintaining validity. As utilized herein, the following terms have the following definitions.

In several embodiments;

"knobs" means "any industry standard size and shape of material which would extend outward radially from the cap of the halo brim for the purpose of engaging with or attaching a face shield to the improved halo brim. This includes specifically the shape of a mushroom with a flattened head".

"Hooks" means any material shaped and sized at the ends of the improved halo brim and designed to allow attachment of an elastic band, tie or string to secure the improved halo brim to the head of a wearer.

"Engage" when used in reference to the lip engaging the cap means the extension of the edge of the lip over, under or into the edge of the cap such that the gap between the frame and the cap is closed off or sealed. This may include a variety of interacting shapes or angles which would mate together to provide the seal. This may also include the use of multiple edges on either the lip, the cap or on both.

While preferred embodiments have been shown, and described, modifications thereof can be made by one skilled in the art without departing from the scope or teaching herein. The embodiments described herein are exemplary only and are not limiting. Many variations and modifications of the system and apparatus are possible and will become apparent to those skilled in the art once the above disclosure is fully appreciated. For example, the relative dimensions of various parts, the materials from which the various parts are made, and other parameters can be varied.

FIG. 1 illustrates one embodiment of the present invention in an assembled view from the three-quarter side view. With reference to FIG. 1, the face shield assembly 100 comprises a face shield 10 mounted to the modified halo brim 20. In one embodiment of the present invention, the modified halo brim 20 comprises the frame 23, the lip 24, the cap 21, the cap slots 22, the knobs 25, the bridge 27, and optionally, hooks 32. In some embodiments, the cap 21 is manufactured from nontransparent material to block light. In some embodiments, the cap 21 is manufactured from a transparent material with a coating or tinting to block light. As illustrated, in some embodiments, the face shield 10 is mounted to the halo cap 21 by inserting the two sides of the shield into the cap slots 22 provided on the cap 21 of the halo brim 20, and then mating the detents/holes 11 of the face shield 10 to the knobs 25 on the edge of the cap 21 of the halo brim 20. In some embodiments of the invention, the knobs 25 are of an industry standard and in other embodiments are shaped like a mushroom with a flattened head. In some embodiments of the present invention, the face shield 10 has multiple sets of detents/holes 11 to allow a wearer to adjust the angle between the face shield 10 and the cap 21. In some embodiments of the present invention, the face shield 10 is optically clear; in other embodiments the face shield 10 may be coated or tinted. In some embodiments of the present invention, the frame 23 of the improved halo brim 20 is flexible. In some embodiments of the present invention, the improved halo brim 20 is manufactured as a single piece. In some embodiments of the present invention, the improved halo brim 20 is manufactured in an injection molding process; in other embodiments, the improved halo brim 20 is manufactured with a 3D Printing process; and in other embodiments, the improved halo brim 20 and/or its parts may be manufactured in a machining or stamping process. In some embodiments of the present invention, the improved halo brim 20 is manufactured from two or more pieces and assembled by mechanical connectors, glued or welded. In some embodiments of the present invention, the improved halo brim 20 is manufactured from polystyrene, other plastic, metal, rubber or fibrous material. In some embodiments of the present invention, the improved halo brim 20 is manufactured from material infused with zinc and/or copper to enhance its antimicrobial/antifungal properties. In some embodiments of the present invention, the cap 21 has a width of between 0.5 inches and 1.5 inches to provide a minimal space between the face shield 10 and the face of a wearer to provide more comfort and to decrease fogging of the face shield 10. In some embodiments of the current invention, the top of the cap 21 is used to display the imprints of names and/or logos.

Figure 2:
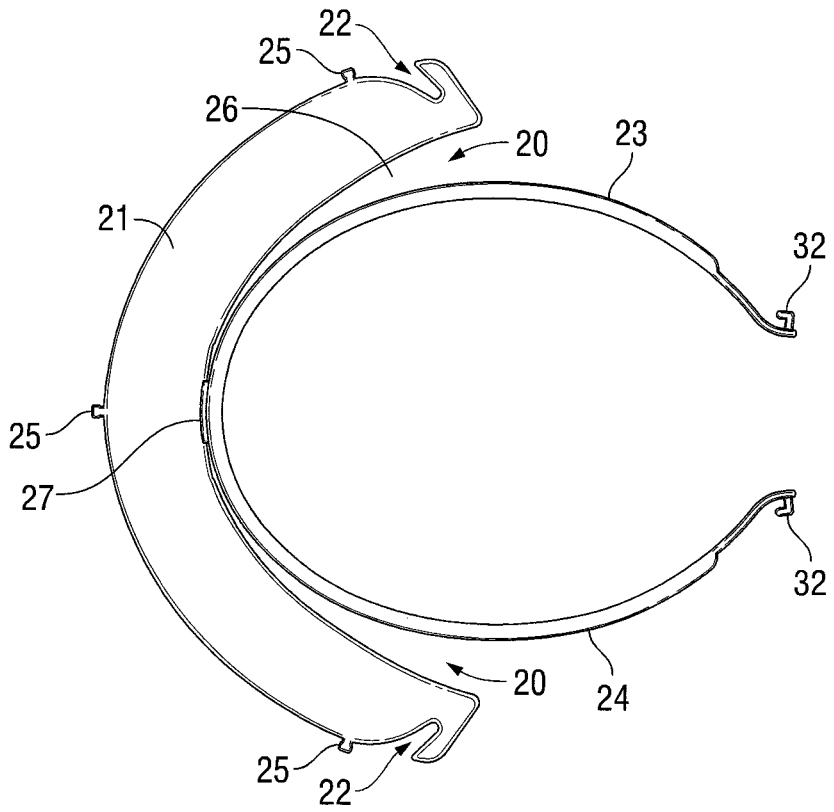
FIG. 2 illustrates one embodiment of the improved face shield assembly, shown from a top view with the frame in a relaxed or unflexed position.

FIG. 2 illustrates one embodiment of the halo brim 20 from a top view. As illustrated, the halo brim 20 is in its relaxed (not being worn) position, the frame 23 is relaxed, and the lip 24 does not engage the edge of the cap 21. This relaxed position leaves a gap 26 between the lip 24 and the cap 21. In some embodiments of the present invention, the lip 24 may be of varying shapes and widths to encourage engagement with the cap 21. In some embodiments of the present invention, the lip 24 may be manufactured as one piece with the cap 21 leaving no gap 26.

In some embodiments of the present invention, the halo brim 20 is manufactured such that the frame 23 and the cap 21 are one piece with the attachment at the bridge 27 being a small section of shared material on the centerline of the arc of both pieces. In some embodiments of the present invention, the halo brim 20 may be manufactured in two or more separate pieces which may be joined in an assembly process by mechanical means, such as by rivets, by glue, by welding or by some combination of the above. In some embodiments of the present invention, the halo brim 20 may be manufactured by a molding or 3D printing process using polystyrene, other plastic, metal, rubber, or fibrous material; or of any combination thereof.

In some embodiments of the present invention, the halo brim 20 may be manufactured from material infused with zinc and/or copper to enhance its antimicrobial/antifungal properties.

Figure 3:
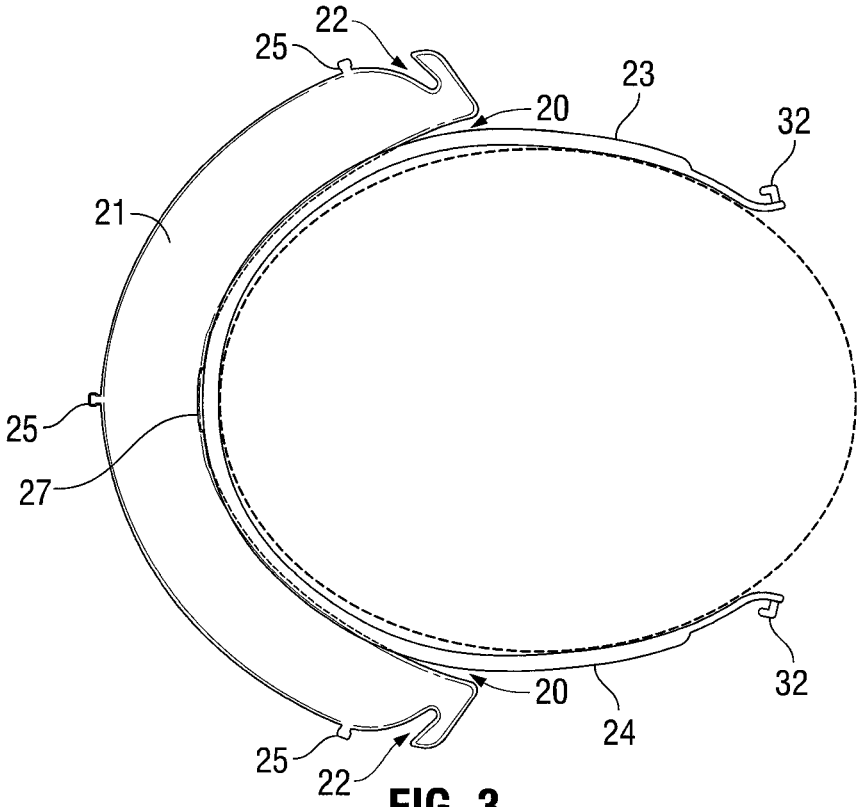
FIG. 3 illustrates one embodiment of the improved face shield assembly, shown from a top view with the frame in the flexed position as if on a wearer of the assembly.

FIG. 3 illustrates one embodiment of the halo brim 20 from a top view. In this view, the assembly 100 is illustrated in the flexed (being worn) position, the frame 23 is shown flexed outward as if around a wearer's head. In this illustration, the lip 24 of the frame 23 has extended radially beyond the edge of the cap 21. In this position, the gap 26 is closed off or sealed. In some embodiments of the present invention, the lip 24 may be of varying sizes and shapes to better engage the cap 21.

Figure 4:
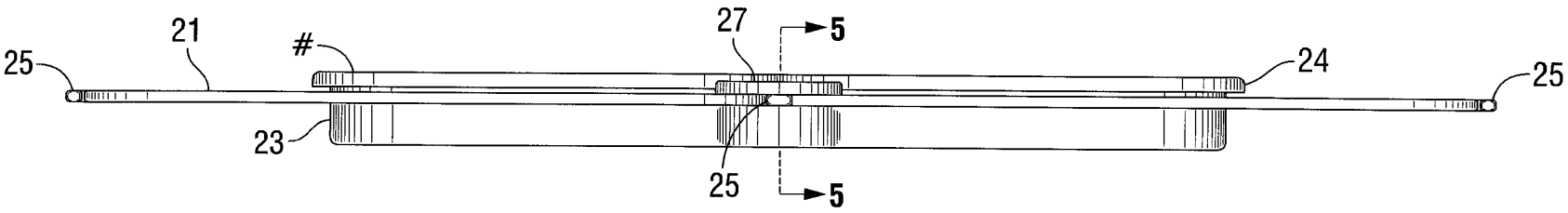
FIG. 4 illustrates an embodiment of the improved face shield assembly, shown from a front view with the frame in the flexed position.

FIG. 4 illustrates one embodiment of the halo brim 20 in a front view, expanded as on a wearer. As illustrated, the lip 24 of the frame 23 has engaged, by extending radially beyond the edge of the cap 21. In this position, the gap 26 is closed off or sealed.

Figure 5:
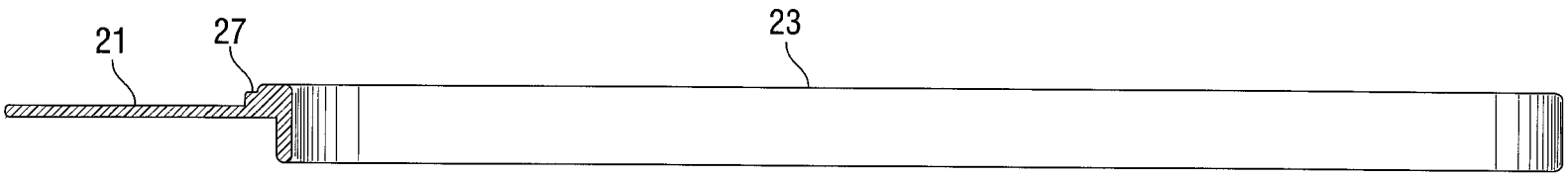
FIG. 5 illustrates one embodiment of the halo brim in a side view in section.

FIG. 5 illustrates one embodiment of the halo brim 20 in a side section view. This view illustrates that the cap 21 is designed to be at least 0.5 to 1.5 inches in width so that the shield 10 is held away from the face of a wearer by the cap 21 of the halo brim 20.

Figure 6:
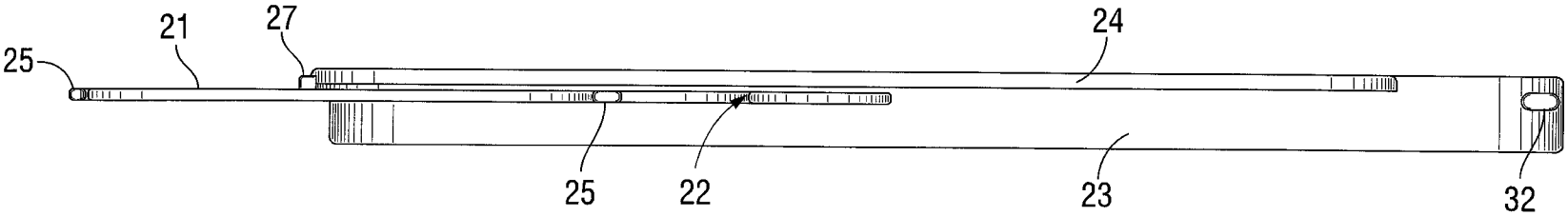
FIG. 6 illustrates one embodiment of the halo brim from a side view.

FIG. 6 illustrates one embodiment of the halo brim 20 from a side view. As illustrated in FIG. 6, in some embodiments of the present invention, the relationship between the lip 24 and the cap 21 is shown. In this illustration, the lip 24 is situated such that it sits over the cap 21 of the halo brim 20, so that upon expansion as illustrated in FIG. 1 and FIG. 3 the lip 24 extends radially over the top of the cap 21 of the halo brim 20. In some embodiments of the present invention, the lip 24 may engage the cap 21 by extending beyond and below the edge of the cap 21. In some embodiments of the present invention, the lip 24 may engage a groove or matching angle(s) provided in the edge of the cap 21.

Figure 7:
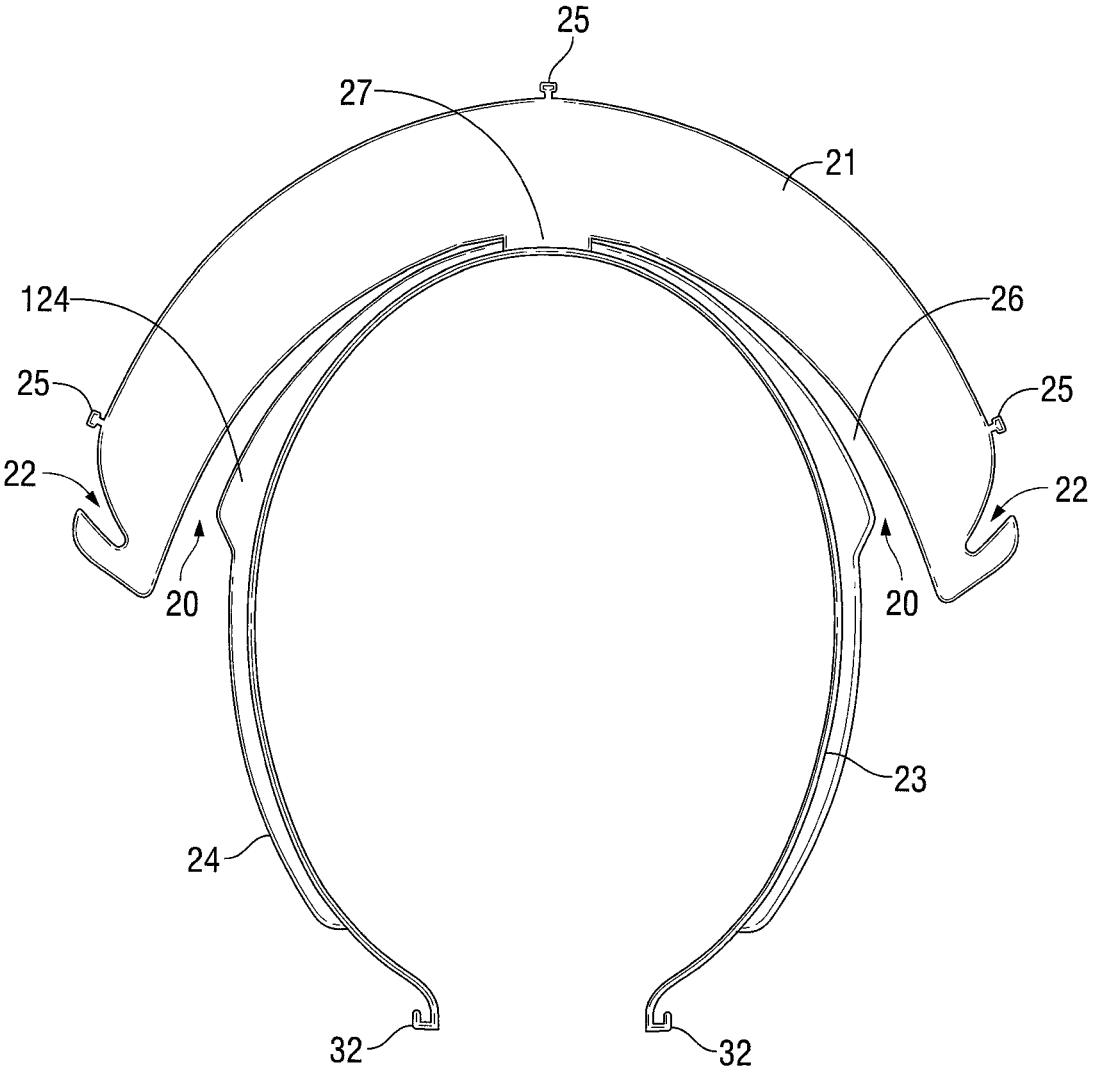
FIG. 7 illustrates one embodiment of the halo brim with a flared lip shown from a top view in a relaxed or unflexed position.

FIG. 7 illustrates one embodiment of the halo brim 20 from a top view. In some embodiments of the present invention, the lip 124 may be of varying shapes and widths to encourage engagement with the cap. As shown in FIG. 7, in some embodiments of the present invention, the lip 124 may flair outward from a point near the bridge 27 of the frame 23. In some embodiments of the present invention, the lip 124 may flair outward distal from the frame 23 as needed to provide for better engagement.

While preferred embodiments have been shown and described, modifications thereof can be made by one skilled in the art without departing from the scope or teaching herein. The embodiments described herein are exemplary only and are not limiting. Many variations and modifications of the system and apparatus are possible and will become apparent to those skilled in the art once the above disclosure is fully appreciated. For example, the relative dimensions of various parts, the materials from which the various parts are made, and other parameters can be varied. Accordingly, it is intended that the following claims be interpreted to embrace all such variations and modifications.

The invention claimed is:

1. An improved halo brim comprising:

a frame having a first arc, a cap having a second arc, and a bridge;

wherein said frame and said cap are fixedly joined by said bridge, wherein said bridge is formed at a centerline bisecting said first arc and said second arc;

said frame further comprising a lip that extends substantially around an outer edge of the frame;

said cap further comprising one or more cap slots and one or more knobs;

wherein each of said cap slots is for receiving and engaging a side edge of a face shield and wherein each of said knobs matingly engage with a hole formed on a surface of said face shield;

wherein gaps around the bridge are reduced when the lip contacts the cap, creating a seal to prevent the downward mitigation of contaminants and/or particles from entering through substantially most of the gap by the frame flexing outwardly, when the improved halo brim is worn.

2. The improved halo brim of claim 1 further comprising: said frame is flexible.

3. The improved halo brim of claim 1 further comprising: said frame and said cap consist of a single piece of material.

4. The improved halo brim of claim 1 further comprising: said frame comprises two or more pieces material joined with a mechanical connection, glue or weld.

5. The improved halo brim of claim 1 further comprising: said frame comprises a material made of: plastic, metal, rubber, or fibrous material.

6. The improved halo brim of claim 1 further comprising: said frame comprises material infused with zinc and/or copper to enhance its antimicrobial/antifungal properties.

7. The improved halo brim of claim 1 further comprising: said cap has a width between 0.5 inches and 1.5 inches.

8. An improved face shield assembly comprising:

an improved halo brim, and a face shield;

said improved halo brim further comprising a frame, a cap, and a bridge, wherein said bridge fixedly joins said frame to said cap at a centerline, wherein said centerline bisects a first arc formed by said frame and a second arc formed by said cap;

said frame further comprising a lip that extends substantially around an outer edge of the frame;

said cap further comprising a plurality of cap slots and one or more knobs;

said face shield comprises a first and second side edge;

said face shield further comprises one or more detents or holes formed on a surface of said face shield;

wherein said face shield is attached to the cap of the improved halo brim by inserting the first and second side edges of the face shield into the cap slots and matingly engaging the knobs of the cap with the detents or holes formed on the surface of the face shield;

wherein said face shield is held by the cap at a distance away from a wearer's face;

wherein gaps around the bridge are reduced when the lip contacts the cap, creating a seal to prevent the downward mitigation of contaminants and/or particles from entering through substantially most of the gap by the frame flexing outwardly, when the improved halo brim is worn.

9. The face shield assembly of claim 8 further comprising:

said cap has a width between 0.5 inches and 1.5 inches.

10. The improved halo brim of claim 8 further comprising:

said frame is flexible.

11. The improved halo brim of claim 8 further comprising:

said frame and said cap consist of a single piece of material.

12. The improved halo brim of claim 8 further comprising:

said frame comprises two or more pieces of material joined with a mechanical connection, glue or weld.

13. The improved halo brim of claim 8 further comprising:

said frame comprises material infused with zinc and/or copper to enhance its anti-viral properties.

14. A method of preventing contaminants and/or particulates from migrating vertically downward into the face of a wearer of a face shield assembly comprising:

obtaining an improved halo brim comprising;

a frame having a first arc, a cap having a second arc, and a bridge;

wherein said frame and said cap are fixedly joined by said bridge, wherein said bridge is formed at a centerline bisecting said first arc and said second arc;

said frame further comprising a lip that extends substantially around an outer edge of the frame;

said cap further comprising one or more cap slots and one or more knobs;

assembling the face shield assembly by attaching the face shield to the improved halo brim by inserting the side edges of the face shield into the to the one or more cap slots of the improved halo brim and inserting the one or more knobs of the cap into the detents or holes of the face shield;

placing the face shield assembly on the head of a wearer, thereby outwardly flexing the frame of the improved halo brim such that the lip of the frame extends outwardly to engage an edge of the cap of the improved halo brim; and wherein gaps around the bridge are reduced when the lip contacts the cap, creating a seal to prevent the downward mitigation of contaminants and/or particles from entering through substantially most of the gap by the frame flexing outwardly, when the improved halo brim is worn.

15. The method of claim 14 further comprising;

said frame is flexible.

16. The method of claim 14 further comprising;

said frame is manufactured as a single piece.

17. The method of claim 14 further comprising;

said frame is manufactured in two or more pieces assembled by mechanical connection, glued or welded.

18. The method of claim 14 further comprising;

said halo frame is manufactured from plastic, metal, rubber or fibrous material.

19. The method of claim 14 further comprising;

said halo frame is manufactured from molding or printing material infused with zinc and/or copper to enhance its antimicrobial/antifungal properties.

20. The method of claim 15 further comprising:

said halo cap has a width between 0.5 inches and 1.5 inches.

* * * * *